United States Patent [19]

Danielson

[11] Patent Number: 4,975,163

[45] Date of Patent: Dec. 4, 1990

[54] ELECTROCHEMICAL REFRACTORY METAL STRIPPER AND PARTS CLEANING PROCESS

[75] Inventor: Donald D. Danielson, Aloha, Oreg.

[73] Assignee: Intel Corporation, Santa Clara, Calif.

[21] Appl. No.: 457,394

[22] Filed: Dec. 27, 1989

[51] Int. Cl.[5] ..... C25F 5/00

[52] U.S. Cl. ..... 204/146

[58] Field of Search ..... 204/146

[56] References Cited

U.S. PATENT DOCUMENTS 4,128,463 12/1978 Formanik ..... 204/146

4,283,258 8/1981 Vanderpool ..... 204/146

*Primary Examiner*—T. M. Tufariello

*Attorney, Agent, or Firm*—Blakely, Sokoloff, Taylor & Zafman

[57] ABSTRACT

An electrochemical process for removing deposited tungsten from metal parts is described. The electrolyte solution is a basic solution containing a polydentate ligand. The solution is typically comprised of water, ammonium or alkali base, and a chelating or sequestering agent. The parts to be cleaned are biased anodically. The cathodes are preferably constructed of nickel. As hydroxide tungsten complexes and chelated tungsten complexes are formed, oxidation and dissolution of the deposited tungsten is promoted. The oxides form a thin layer on the metal parts, thus protecting the underlying metal part from the electrochemical reaction itself. Once the oxides are formed, that is, once the reaction has reached an end, the parts are removed. The oxides are wiped off, leaving a metal part surface with a high luster, thus improving the performance of the deposition equipment parts.

14 Claims, 2 Drawing Sheets

ELECTROCHEMICAL REFRACTORY METAL STRIPPER AND PARTS CLEANING PROCESS

BACKGROUND OF THE PRESENT INVENTION

1. Field of the Invention

This invention relates to a metal cleaning process for removing metal deposits and more particularly, an electrochemical process and apparatus for removing refractory metal deposits on deposition equipment parts used in semiconductor fabrication.

2. Prior Art

Chemical vapor deposition (CVD) is defined as the formation of non-volatile solid film on a substrate by reaction of vapor phase chemicals (reactants) that contain the required constituents. The reactant gases are introduced into a reaction chamber and are decomposed and reacted at a heated surface to form a thin film. A wide variety of thin films utilized in very large scale integration (VLSI) fabrication are prepared by CVD.

Typically, refractory metal films are deposited on substrates using any number of well-known vapor deposition processes. The deposition technology and equipment used to prepare such films by CVD are well-known in the semiconductor industry. Furthermore, the thin films created by CVD are used in a variety of different applications in VLSI fabrication and may be prepared using a variety of techniques. However, the method by which they are formed must meet certain requirements. The process must be economical, that is, it must be capable of producing a high through-put. Additionally, the resulting films must exhibit some of the following characteristics: (a) good thickness uniformity, (b) high purity and density, (c) controlled composition and stoichiometries, (d) high degree of structural perfection, (e) good electrical properties, (f) excellent adhesion and (g) good step coverage.

All of these characteristics depend in part on the capabilities of the equipment used. Additionally, contaminants in the system reaction chamber could generate particles, which are then deposited onto the wafers and produce lower yields. The lower yields result in poor electrical properties, including electrical breakdown. Furthermore, purity of the film suffers as well as the film uniformity.

After a number of through-puts some of the deposition equipment used within the reaction chamber itself, such as the chucks and clamps, become coated with refractory metal deposits. The metal parts, typically fabricated from Monel® become coated with a thin layer of tungsten. Monel® is the trademark used by International Nickel Co., Inc. for a metal alloy containing nickel and copper. The refractory metal deposits on the deposition parts encumber the efficiency of the equipment, as well as produce particles that then flake off and are deposited on the wafers.

Typically, there are several means of avoiding the problem of refractory metal deposits. One way, and generally the most expensive way, is to completely replace the deposition parts with new manufacturer's parts.

Another way of dealing with the coated parts, is to return them to the manufacturer to be remachined. While this is useful in that the manufacturer will remachine the parts, thus removing the metal coating, the parts are eventually destroyed and may only be used once again. Furthermore, the cost is almost as prohibitive as purchasing new parts.

A third way, traditionally used is to bead blast the parts. This is done by using a micro bead blaster. Generally, selection, size and composition of the bead must be considered when determining the suitability of bead blasting. These factors determine the extent of efficiency of the blasting technique for removing the deposited metal. They are also indicative of the expected extent of damage inflicted on the parts as a result of bead blasting. Additionally, the economic disadvantage of manufacturer's remachining or purchasing of new parts is essentially the same, in that it is costly and eventually destructive.

Typically, bead blasting of the coated parts is performed only once since this technique leads to their destruction. Among other things, bead blasting damages the parts by pitting the surface. This degrades sealing capabilities of the parts and drastically shortens the life expectancy of the parts. This eventually leads to a degradation of the performance of the assembled process equipment, which in turn, results in a reduced yield of semiconductors devices.

Disadvantageously, the current bead blasting techniques require approximately 24 hours of down time per part set. On the average, the cleaning and discarding of the parts after one cleaning process currently used, requires 8 to 12 sets of deposition parts per year per deposition chamber.

Therefore, what is needed is a method of cleaning the deposition equipment parts without causing structural damage to these parts as well as decreasing the part cleaning through-put time. The present invention provides an electrochemical approach to replace the mechanical bead blasting of cleaning the parts currently used. The refractory metal is dissolved from the surface of the parts using an electrochemical process.

SUMMARY OF THE PRESENT INVENTION

The present invention describes a process for electrochemically removing tungsten deposits on deposition equipment parts. Once the deposit build-up is sufficient to effect the efficiency of the deposition equipment, the deposition equipment parts are electrochemically cleaned by attaching the metal part to a part support, which is also electrically connected to an anode bus bar. The metal parts are hung from the part support into an aqueous electrolytic solution. The electrolytic solution is basic, generally containing ammonium or alkali base and a chelating or sequestering agent.

The parts are positioned between a pair of cathodes, typically constructed of nickel. As the reaction progresses, hydroxy tungsten complexes and chelated tungsten complexes are formed, thus promoting oxidation of the deposited anodic tungsten. As the tungsten is dissolved, an oxide layer is formed on the metal parts. Once the reaction has reached an end, that is, there is no deposited tungsten left to react, the parts are removed from the electrolytic solution and the oxide layer is wiped off. Once the oxide layer is wiped off, a high-luster surface is exposed. This permits the deposition part to be reused, and in most cases, improves the performance by providing a high-luster surface.

DETAILED DESCRIPTION OF THE PRESENT INVENTION

An invention is described that provides for an electrochemical process that chemically removes refractory metals deposits from deposition equipment parts. As a result of this process metal parts that had to be discarded after two uses can now be reused, thus providing a more economical process and a higher through-put efficiency. In the following description, numerous specific details are set forth such as specific concentrations of solutions or specific currents and temperatures in order to provide a more thorough understanding of the present invention. It will be obvious, however, to one skilled in the art that the present invention may be practiced without the specific details. In other instances, well-known processes have not been described in detail in order not to unnecessarily obscure the present invention.

Figure 1:
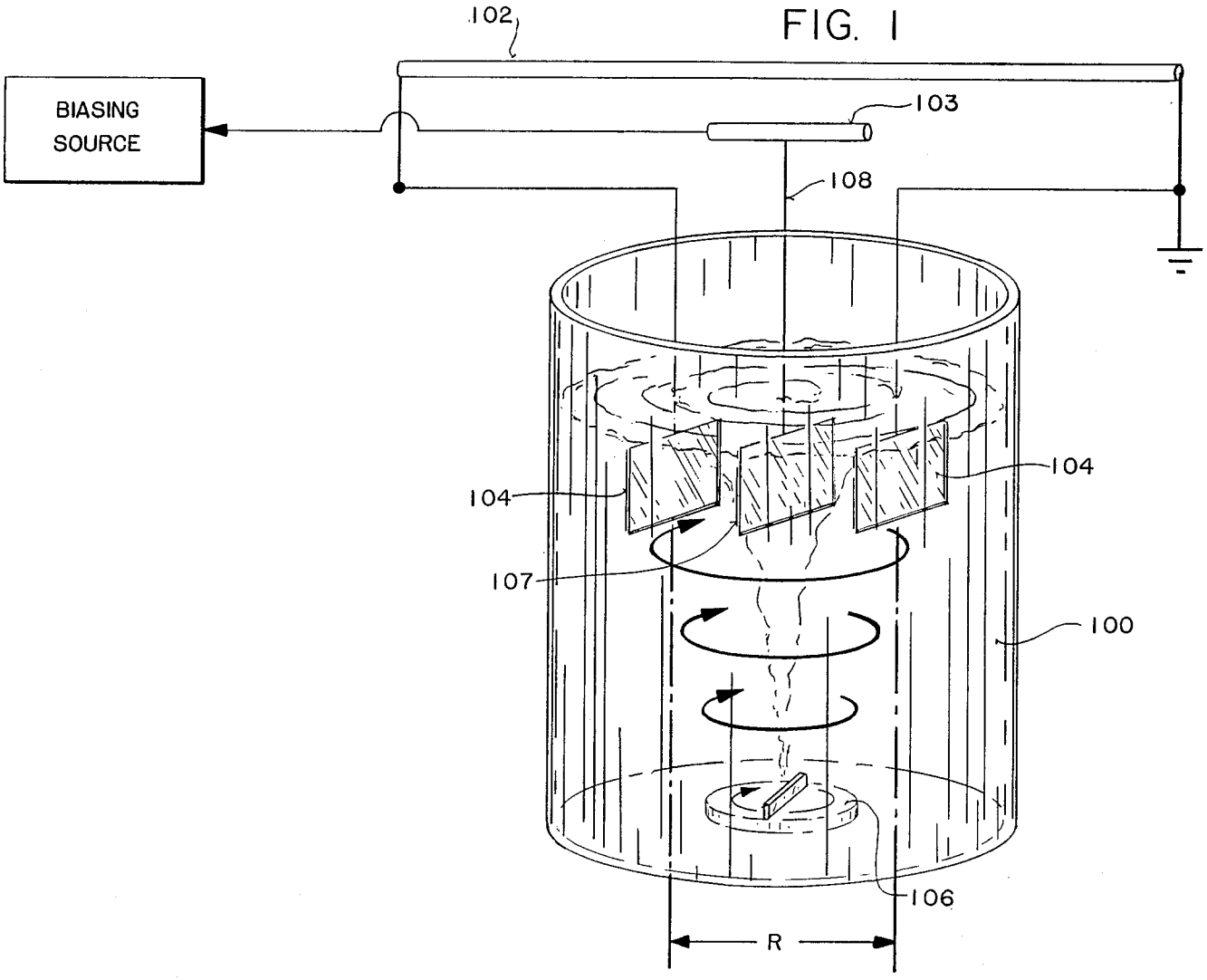
FIG. 1 is perspective view of the apparatus used to practice the present invention.

FIG. 1 illustrates the apparatus and process of the present invention. The apparatus is comprised of a cleaning tank 100, a plurality of cathodes 104, a cathode bus bar 102, and anode bus bar 103, a thermostat and circulator 105 and parts supports 108.

As the metal parts 107, typically fabricated from Monel® become coated with tungsten deposits, the up-time, maintenance interval and efficiency of deposition equipment decreases. The present invention provides an electrochemical approach to replace the older mechanical approach of bead blasting to clean these metal parts 107.

Initially, a cleaning tank 100 is filled with an electrolyte solution 101. Typically the electrolyte solution 101 a basic solution containing polydentate ligands. The solution 101 is typically comprised of water, ammonium or alkali base and a chelating or sequestering agent.

An example of an electrolyte solution 101 in the preferred embodiment is an aqueous solution containing a mixture of 100 grams of potassium oxalate and 500 grams of potassium hydroxide (KOH) per 1 gallon of deionized water.

The tungsten-coated metal parts 107 are positioned at the end of the part support 108. The part support 108 is electrically connected to a metal part 107 at one end. While the other end of the part support 108 is electrically connected to an anode bus bar 103. This enables the tungsten-coated metal parts 107 to be suspended in the cleaning tank 100, in the electrolyte solution 101. The tungsten-coated parts 107 are functionally equivalent to the anodes in an electrochemical cell, with a plurality cathodes 104 previously positioned on a cathode bus bar 102. The cathodes 104 are typically constructed of nickel. However, the cathodes 104 may be any other functional equivalent and still be within the spirit and scope of the present invention.

As the electrochemical reaction proceeds soluble hydroxy tungsten complexes and tungsten polycarboxcylic chelate complexes are formed and promote the oxidation of tungsten. A thin layer of dark brown to black oxides is formed on the exposed surface of the metal parts 104. The oxides prevent further attack of the parts 104 and are easily wiped off. This results in a smoother part 104 surface. As a result, small machining marks, on the order of 0.001 inch by 0.001 inch are gradually smoothed out over several cleanings. Not only are all the metal deposits removed, but the surfaces have a tendency to be improved. Wiping the oxides off the parts 104 at the end of the process produces a high luster.

Although the electrochemical reaction will proceed without biasing, the preferred embodiment of the present invention applies a positive bias of approximately 0.2 amperes per square inch of the part 104 surface area. It has been determined that biasing increases the tungsten dissolution rate by approximately 3 to 4 times the rate of dissolution without biasing.

Additionally, heating the electrolyte solution 101 to a temperature in the range of 40° C. to 70° C. increases the cleaning efficiency of the electrochemical reaction. However, using the electrolyte solution 101 at a temperature below 40° C. would not be outside the scope of the present invention.

In the preferred embodiment, the nickel cathodes 104 are designed to mimic the contour of the parts 107 since this improves efficiency of tungsten removal. However, cathodes not specifically contoured are still within the principles of the present invention. Additionally, to promote efficient tungsten removal, a single metal part 107 is positioned equidistant between a pair of cathodes 104. In the preferred embodiment, distance between the pair of cathodes 104 is in the range R of 2 to 3 inches. The cathodes 104 are preferably 1 inch from the surface of the parts 107. However, since the distance between the cathodes 104 is dependent on the geometry of the parts 107 and the parts 107 have a finite thickness, the range R may vary.

Using the present invention, the cleaning time of the metal parts 107 is reduced from 24 to 36 hours to 30 to 45 minutes for the clamp rings. A chuck part takes about twice as long as a ring. Generally, a chuck part is a massive wafer holder, while a single metal part 107 is a clamp ring used to keep the wafer in the holder. The assembly of the two parts is chuck.

Figure 2:
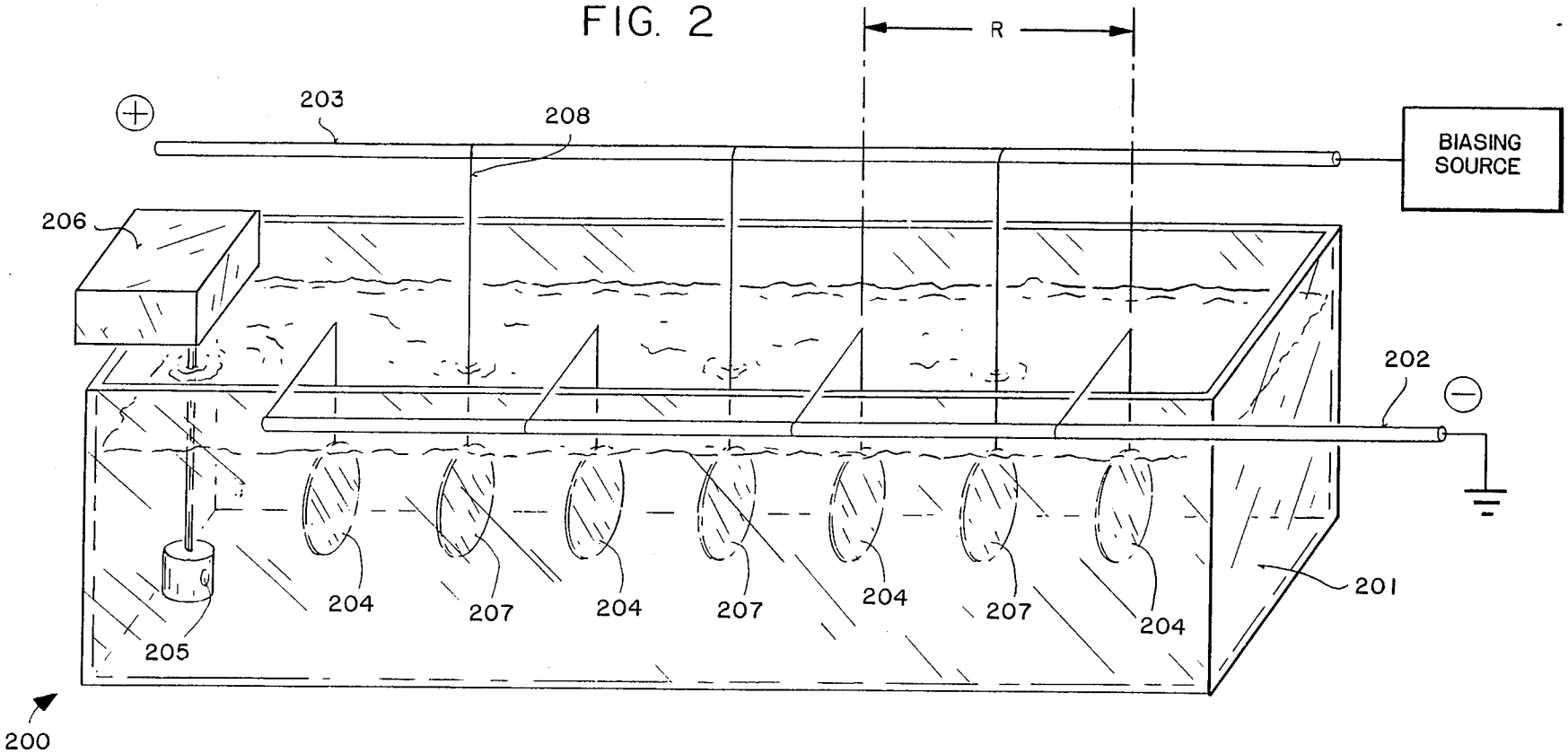
FIG. 2 is a perspective view of an alternative apparatus used to practice the present invention on an up-scaled production level.

FIG. 2 illustrates the apparatus for practicing the present invention on an up-scaled production level.

The apparatus is comprised of a cleaning tank 200, a plurality of cathodes 204, a cathode bus bar 202, an anode bus bar 203, a thermostat and circulator 206 and a plurality of parts supports 208.

The process for removing tungsten deposits from metal parts 207 proceeds as illustrated in FIG. 1. However, the circulator 106 (FIG. 1) is replaced with a combination thermostat and circulator 206, wherein the thermostat sensor 205 regulates the temperature of the electrolyte solution 201. Similar to the apparatus shown in FIG. 1, a single metal part 207 is positioned equidistant between a pair of cathodes 204, such that the following arrangement is observed in the tank 200:

| Cathode | Part | Cathode | Part | Cathode | Part | Cathode |
|---|---|---|---|---|---|---|
| (204) | (207) | (204) | (207) | (204) | (207) | (204) |

As illustrated in FIG. 1, the process is practiced in a similar manner, whether it is on a small scale prototype fabrication run or in a large-scale fabrication plant.

Practicing the present invention on an up-scaled production level extends the cleaning time to approximately 4 hours for a complete set of parts. Using the present invention permits the reuse of a set of parts 10 times over that of bead blasting. This reuse of a set of parts significantly reduces down time, decreases through-put time and is cost effective.

Thus, a novel method for removing tungsten deposits on deposition equipment using an electrochemical reaction is described.

I claim:

1. A process for removing tungsten deposits from a metal part comprising the steps of:

preparing an electrolyte solution and placing said solution in a cleaning tank such that the level of said solution encompasses the top of a pair of cathodes;

positioning the metal part at the end of the part support and between said pair of cathodes;

biasing positively said metal part;

oxidizing tungsten deposits on said metal part, such that said tungsten deposits are dissolved while forming a thin oxide layer on said metal part;

removing said metal part from said electrolyte solution;

removing said thin oxide layers such that the clean metal surfaces is exposed.

2. The process as recited in claim 1, wherein said electrolyte solution is comprised of a 1 to 2 ratio of potassium oxalate and potassium hydroxide per gallon of deionized water.

3. The process as recited in claim 2, wherein said oxidizing step further includes creating hydroxy tungsten complexes and chelated tungsten complexes.

4. The process as recited in claim 3, wherein said oxidizing step further includes heating said electrolyte solution to a temperature in the range of 40° C. to 50° C.

5. The process as recited in claim 4, wherein said biasing said step further includes applying a current in the range of 0.2 amps to 1 amp per square inch of said metal surface.

6. The process as recited in claim 5, wherein said pair of cathodes are designed to follow the contour of said metal part.

7. The process as recited in claim 6, wherein said pair of cathodes are prefabricated from nickel.

8. The process as recited in claim 7, wherein said metal part is fabricated from a nickel and copper alloy.

9. A process for removing tungsten deposits from metal deposition parts comprising the steps of:

preparing an electrolyte solution comprised of water, alkali, and chelating agents;

filling a cleaning tank to a predetermined level with said electrolyte solution, wherein said electrolyte solution covers a top of a plurality of cathodes;

heating said electrolyte solution to a temperature of 40° C. to 50° C.;

positioning of plurality of metal parts at the end of the part support, wherein a single part support is electrically connected to a single metal part of said plurality of metal parts at one end and electrically connected to an anode bus bar at the other end;

biasing said anode bus bar;

oxidizing and dissolving tungsten deposits on said plurality of metal parts by forming hydroxy tungsten complexes and tungsten polycarboxcylic chelate complexes;

removing said metal parts from said electrolyte solution after a thin tungsten oxide layer has been formed on said metal parts;

polishing said metal parts while removing said thin oxide layer from said metal parts.

10. The process as recited in claim 9, wherein said plurality of cathodes are fabricated from nickel.

11. The process as recited in claim 10, wherein said metal parts are fabricated from an alloy of nickel and copper.

12. The process as recited in claim 11, wherein said biasing step further includes positively biasing to a current in the range of 0.2 amperes per square inch of of said metal part surface.

13. The process as recited in claim 12, wherein said positioning step further includes the step of positioning said plurality of metal parts and said plurality of cathodes such that a single metal part is positioned equidistant between a pair of cathodes.

14. The process as recited in claim 13, wherein said plurality of cathodes are contoured to the shape of said plurality of metal parts.

* * * * *